US010723592B2

(12) United States Patent
Dudde

(10) Patent No.: US 10,723,592 B2
(45) Date of Patent: Jul. 28, 2020

(54) SYSTEM AND METHOD FOR MONITORING AN ELEVATOR BELT

(71) Applicants: ThyssenKrupp Elevator AG, Essen (DE); thyssenkrupp AG, Essen (DE)

(72) Inventor: Frank Peter Dudde, Memphis, TN (US)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 496 days.

(21) Appl. No.: 15/788,576

(22) Filed: Oct. 19, 2017

(65) Prior Publication Data

US 2019/0119071 A1 Apr. 25, 2019

(51) Int. Cl.

| | |
|---|---|
| ***B66B 7/08*** | (2006.01) |
| ***B66B 7/12*** | (2006.01) |
| ***B66B 5/00*** | (2006.01) |

(52) U.S. Cl.

CPC ..... *B66B 7/1215* (2013.01); *B66B 5/0025* (2013.01); *B66B 5/0031* (2013.01); *B66B 5/0037* (2013.01); *B66B 7/085* (2013.01)

(58) Field of Classification Search

USPC ..... 187/393

See application file for complete search history.

(56) References Cited

U.S. PATENT DOCUMENTS

| | | | | |
|---|---|---|---|---|
| 6,484,368 | B1 * | 11/2002 | Rivera | B66B 7/085 24/115 R |
| 9,422,134 | B2 * | 8/2016 | Ikonen | B66B 7/085 |
| 10,562,740 | B2 * | 2/2020 | Zaidi | B66B 7/085 |
| 2014/0182975 | A1 | 7/2014 | Ikonen et al. | |
| 2016/0272466 | A1 | 9/2016 | Helenius | |
| 2018/0155156 | A1 * | 6/2018 | Kuczek | B66B 7/085 |

FOREIGN PATENT DOCUMENTS

| | | | |
|---|---|---|---|
| DE | 29151241 | A1 | 10/1980 |
| JP | 200951650 | A | 3/2009 |

* cited by examiner

*Primary Examiner* — Christopher Uhlir
(74) *Attorney, Agent, or Firm* — The Webb Law Firm

(57) ABSTRACT

An elevator end termination for an elevator belt includes a wedge housing, a segmented wedge disposed axially within the wedge housing. The segmented wedge includes at least two wedge members spaced apart from one another to define a space therebetween. At least one pressure sensor is disposed in the space defined between the at least two wedge members. The at least one pressure sensor registers compressive pressure exerted between the at least two wedge members. The at least two wedge members may include a pair of adjacent longitudinally-extending wedge members, and a wedge crown adjacent a first end of each of the longitudinally-extending wedge members and separated therefrom by a transversely-extending space. The space is a longitudinal slot between the adjacent wedge members.

20 Claims, 9 Drawing Sheets

| Degradation zone | Belt load/load spectrum | | | | |
|---|---|---|---|---|---|
| | Static bend over small radius and clamp pressure | No bends over a sheave, dynamic bends with small radius at clamp entrance | 1 bend over sheave | 2 bends over sheave | 3 bends over sheave |
| PC1 | X | | | | |
| PC2 | X | | | | |
| P0 | | X | | | |
| P1 | | | X | | |
| P2 | | | | X | |
| P3 | | | | | X |
| P4 | | | | X | |
| P5 | | | X | | |
| P6 | | | | X | |
| P7 | | | X | | |
| P8 | | X | | | |

Belt zone with small radius bends and pressure in end termination

Zone with maximal bends over sheaves

FIG. 8

SYSTEM AND METHOD FOR MONITORING AN ELEVATOR BELT

BACKGROUND OF THE INVENTION

Field of the Invention

The present disclosure relates, in general, to an elevator system and, more particularly, to an elevator belt condition monitoring system and method for an elevator system.

Description of Related Art

Current elevator systems typically include an elevator car operatively connected to a tensioning unit or another elevator car to move the elevator car through a hoistway. The elevator car moves individuals to different points in a building. The elevator car and tensioning unit or second elevator car are often operatively connected with at least one elevator belt that is directed over a sheave provided at an upper location within the hoistway. A hoist motor is operatively connected to the sheave to rotate the sheave to move the elevator belt thereon. As the elevator belt is moved, the elevator car is moved within the hoistway.

Current regulations for elevator systems require a continuous monitoring of a residual breaking strength of the elevator belt and, in particular, of polyurethane coated elevator belts. During operation of the elevator system, the elevator belt is exposed to fatigue and a breaking strength of a load carrier within the elevator belt is reduced. In the event the residual breaking strength of one load carrier reaches 60% compared to the breaking strength of a new elevator belt, all of the elevator belts in the elevator system need to be replaced. Typically, the residual breaking strength of the elevator belt cannot be measured directly without breaking and/or destroying the elevator belt. Several elevator belt monitoring methods are known and are based on magnetic flux and/or electrical resistance principles. However, technical limitations of these monitoring methods could impact the acceptance of these monitoring methods by regulatory authorities.

In general, elevator belt pressure monitoring systems and methods should measure a degradation of the whole belt length of the elevator belt, including the portion of the elevator belt covered by an end termination. This type of monitoring is not possible with magnetic flux monitoring methods. Electrical resistance methods measure the whole belt length but send an electrical signal through cords of the elevator belt, which can lead to early belt degradation due to rusted cords, and false alarms due to electrical contact problems.

SUMMARY OF THE INVENTION

Therefore, there is a current need in the art for an elevator system that includes an elevator belt pressure monitoring system that monitors the entire length of the elevator belt including the portion of the elevator belt held in the end termination. Further, there is an additional need in the art for an end termination that includes an elevator belt pressure monitoring system.

In one example of the present disclosure, an elevator end termination for an elevator belt includes a wedge housing, a segmented wedge disposed axially within the wedge housing, wherein the segmented wedge includes at least two wedge members spaced apart from one another to define a space therebetween, at least one pressure sensor disposed in the space defined between the at least two wedge members, and wherein the at least one pressure sensor registers compressive pressure exerted between the at least two wedge members.

In another example of the present disclosure, the at least two wedge members include a pair of adjacent longitudinally-extending wedge members and the space is a longitudinal slot between the adjacent wedge members. The pair of adjacent longitudinally-extending wedge members may include an angled wedge and an opposing counter wedge. The at least one pressure sensor may include a first pressure sensor provided in the longitudinal slot at a first end of the longitudinal slot. The at least one pressure sensor may also include a second pressure sensor provided in the longitudinal slot at a second end of the longitudinal slot. The at least one pressure sensor may include a first pressure sensor provided in the longitudinal slot at a first end of the longitudinal slot, and a second pressure sensor provided in the longitudinal slot at a second end of the longitudinal slot. The at least two wedge members further include a pair of adjacent longitudinally-extending wedge members, and the space is a longitudinal slot between the adjacent wedge members, and a wedge crown adjacent a first end of each of the longitudinally-extending wedge members and separated therefrom by a transversely-extending space. The pair of adjacent longitudinally-extending wedge members include an angled wedge and an opposing counter wedge. The at least one pressure sensor may include a first pressure sensor provided in the longitudinal slot at a first end of the longitudinal slot. The at least one pressure sensor may also include a second pressure sensor provided in the longitudinal slot at a second end of the longitudinal slot. The at least one pressure sensor may include a first pressure sensor provided in the longitudinal slot at a first end of the longitudinal slot, and a second pressure sensor provided in the longitudinal slot at a second end of the longitudinal slot. The wedge crown includes a plurality of adjacent wedge crown elements disposed adjacent the first end of each of the longitudinally-extending wedge members. The transversely-extending space includes a transverse slot, and the at least one pressure sensor includes at least one pressure sensor provided in the transverse slot between the wedge crown and the longitudinally-extending wedge members. The at least two wedge members further include a longitudinally-extending wedge member, and a wedge crown adjacent a first end of the longitudinally-extending wedge member and separated therefrom by a transversely-extending space. The at least one pressure sensor is provided in the transverse space between the wedge crown and the longitudinally-extending wedge member. The wedge crown includes a plurality of adjacent wedge crown elements disposed adjacent the first end of the longitudinally-extending wedge member. The transversely-extending space includes a transverse slot, and the at least one pressure sensor is provided in the transverse slot between the wedge crown and the longitudinally-extending wedge member. The wedge housing includes a first wedge housing member and a second wedge housing member defining a cavity therebetween axially receiving the segmented wedge therein, and wherein the segmented wedge defines a pair of outer longitudinal slots with the first wedge housing member and the second wedge housing member to accommodate an elevator belt reeved through the elevator end termination. The at least two wedge members include a pair of adjacent longitudinally-extending wedge members and the space is a longitudinal slot defined between the adjacent wedge members. The pair of adjacent longitudinally-extending wedge members include an angled wedge and an opposing counter wedge. The angled wedge defines a first angled face and one of the first wedge housing member and the second wedge housing member defines a second angled face disposed opposite the first angled face. A first cover plate and a second cover plate are secured to the first wedge housing member and the second wedge housing member to enclose the cavity, with the segmented wedge axially disposed between the first wedge housing member and the second wedge housing member and between the first cover plate and the second cover plate.

Further examples will now be described in the following numbered clauses.

Clause 1: An elevator end termination for an elevator belt, comprising: a wedge housing; a segmented wedge disposed axially within the wedge housing; wherein the segmented wedge comprises at least two wedge members spaced apart from one another to define a space therebetween; at least one pressure sensor disposed in the space defined between the at least two wedge members; and wherein the at least one pressure sensor registers compressive pressure exerted between the at least two wedge members.

Clause 2: The elevator end termination as claimed in Clause 1, wherein the at least two wedge members comprise a pair of adjacent longitudinally-extending wedge members and the space is a longitudinal slot between the adjacent wedge members.

Clause 3: The elevator end termination as claimed in Clause 2, wherein the pair of adjacent longitudinally-extending wedge members comprise an angled wedge and an opposing counter wedge.

Clause 4: The elevator end termination as claimed in Clause 2 or 3, wherein the at least one pressure sensor comprises a first pressure sensor provided in the longitudinal slot at a first end of the longitudinal slot.

Clause 5: The elevator end termination as claimed in Clause 4, wherein the at least one pressure sensor further comprises a second pressure sensor provided in the longitudinal slot at a second end of the longitudinal slot.

Clause 6: The elevator end termination as claimed in any of Clauses 2-5, wherein the at least one pressure sensor comprises a first pressure sensor provided in the longitudinal slot at a first end of the longitudinal slot, and a second pressure sensor provided in the longitudinal slot at a second end of the longitudinal slot.

Clause 7: The elevator end termination as claimed in any of Clauses 1-6, wherein the at least two wedge members further comprise: a pair of adjacent longitudinally-extending wedge members, and the space is a longitudinal slot between the adjacent wedge members; and a wedge crown adjacent a first end of each of the longitudinally-extending wedge members and separated therefrom by a transversely-extending space.

Clause 8: The elevator end termination as claimed in Clause 7, wherein the pair of adjacent longitudinally-extending wedge members comprise an angled wedge and an opposing counter wedge.

Clause 9: The elevator end termination as claimed in Clause 7 or 8, wherein the at least one pressure sensor comprises a first pressure sensor provided in the longitudinal slot at a first end of the longitudinal slot.

Clause 10: The elevator end termination as claimed in Clause 9, wherein the at least one pressure sensor further comprises a second pressure sensor provided in the longitudinal slot at a second end of the longitudinal slot.

Clause 11: The elevator end termination as claimed in any of Clauses 7-10, wherein the at least one pressure sensor comprises a first pressure sensor provided in the longitudinal slot at a first end of the longitudinal slot, and a second pressure sensor provided in the longitudinal slot at a second end of the longitudinal slot.

Clause 12: The elevator end termination as claimed in any of Clauses 7-11, wherein the wedge crown comprises a plurality of adjacent wedge crown elements disposed adjacent the first end of each of the longitudinally-extending wedge members.

Clause 13: The elevator end termination as claimed in any of Clauses 7-12, wherein the transversely-extending space comprises a transverse slot, and the at least one pressure sensor is provided in the transverse slot between the wedge crown and the longitudinally-extending wedge members.

Clause 14: The elevator end termination as claimed in any of Clauses 1-13, wherein the at least two wedge members further comprise: a longitudinally-extending wedge member; and a wedge crown adjacent a first end of the longitudinally-extending wedge member and separated therefrom by a transversely-extending space.

Clause 15: The elevator end termination as claimed in Clause 14, wherein the at least one pressure sensor is provided in the transverse space between the wedge crown and the longitudinally-extending wedge member.

Clause 16: The elevator end termination as claimed in Clause 14 or 15, wherein the wedge crown comprises a plurality of adjacent wedge crown elements disposed adjacent the first end of the longitudinally-extending wedge member.

Clause 17: The elevator end termination as claimed in Clause 16, wherein the transversely-extending space comprises a transverse slot, and the at least one pressure sensor is provided in the transverse slot between the wedge crown and the longitudinally-extending wedge member.

Clause 18: The elevator end termination as claimed in any of Clauses 1-17, wherein the wedge housing comprises a first wedge housing member and a second wedge housing member defining a cavity therebetween axially receiving the segmented wedge therein, and wherein the segmented wedge defines a pair of outer longitudinal slots with the first wedge housing member and the second wedge housing member to accommodate an elevator belt reeved through the elevator end termination.

Clause 19: The elevator end termination as claimed in Clause 18, wherein the at least two wedge members comprise a pair of adjacent longitudinally-extending wedge members and the space is a longitudinal slot defined between the adjacent wedge members, wherein the pair of adjacent longitudinally-extending wedge members comprise an angled wedge and an opposing counter wedge, and wherein the angled wedge defines a first angled face and one of the first wedge housing member and the second wedge housing member defines a second angled face disposed opposite the first angled face.

Clause 20: The elevator end termination as claimed in Clause 18 or 19, further comprising a first cover plate and a second cover plate secured to the first wedge housing member and the second wedge housing member to enclose the cavity, with the segmented wedge axially disposed between the first wedge housing member and the second wedge housing member and between the first cover plate and the second cover plate.

These and other features and characteristics of the end termination and the elevator belt pressure monitoring system, as well as the methods of operation and functions of the related elements of the system, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the disclosure. As used in the specification and claims, the singular form of "a", "an", and "the" include plural referents unless the context clearly dictates otherwise.

BRIEF DESCRIPTION OF THE DRAWINGS

FIG. 8 is a table showing belt loads for degradation zones for an elevator belt in an elevator system according to an example of the present disclosure.

DESCRIPTION OF THE DISCLOSURE

Figure 1:
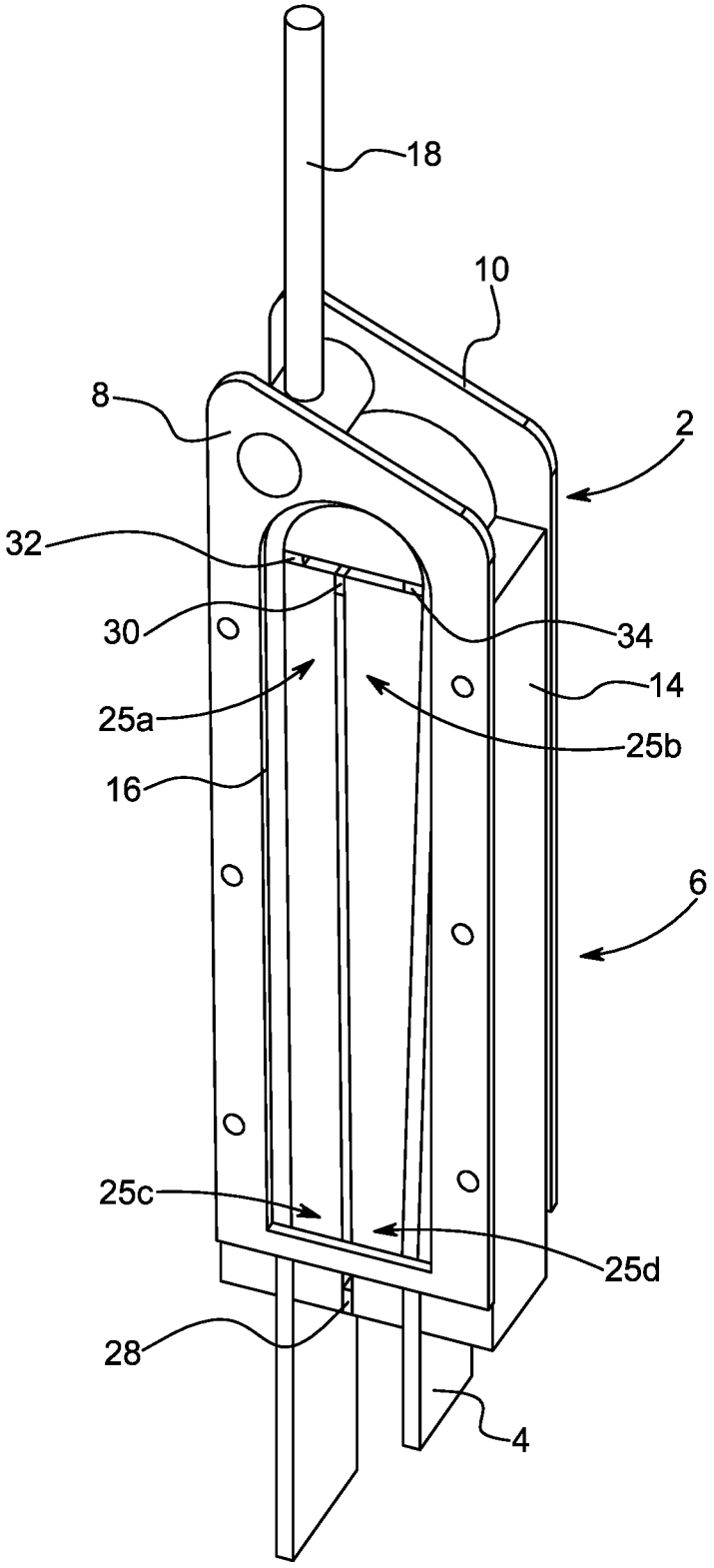
FIG. 1 is a perspective view of an end termination according to an example of the present disclosure.

For purposes of the description hereinafter, the terms "upper", "lower", "right", "left", "vertical", "horizontal", "top", "bottom", "lateral", "longitudinal", and derivatives thereof, shall relate to the invention as it is oriented in the figures. However, it is to be understood that the invention may assume alternative variations and step sequences, except where expressly specified to the contrary. It is also to be understood that the specific systems and processes illustrated in the attached drawings, and described in the following specification, are simply exemplary examples of the invention. Hence, specific dimensions and other physical characteristics related to the examples disclosed herein are not to be considered as limiting.

As used herein, the terms "communication" and "communicate" refer to the receipt, transmission, or transfer of one or more signals, messages, commands, or other types of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, encrypted, processed, routed, etc., between the first and second unit or device. It will be appreciated that numerous arrangements are possible. Any known electronic communication protocols and/or algorithms may be used such as, for example, UDP, TCP/IP (including HTTP and other protocols), WLAN (including 802.11 and other radio frequency-based protocols and methods), analog transmissions, cellular networks, and/or the like.

Referring to the drawings in which like reference numerals refer to like parts throughout the several views thereof, the present disclosure is generally directed to an elevator belt pressure monitoring system and method for an elevator system and, more particularly, to a mechanical elevator belt pressure monitoring system and method arranged in an end termination of the elevator system.

Figure 2A:
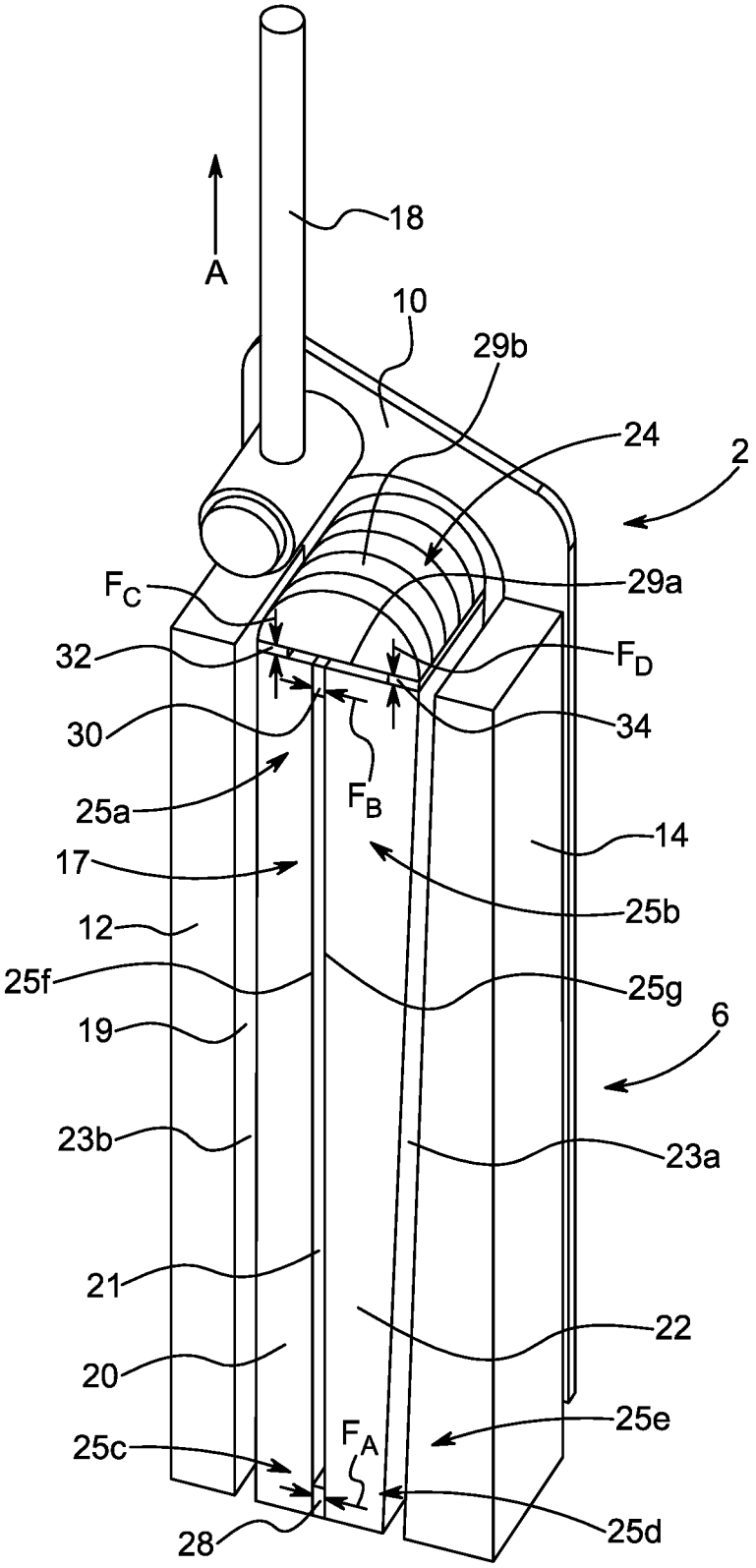
FIG. 2A is a perspective view of the end termination of FIG. 1 with a front plate removed.

With reference to FIGS. 1 and 2A, an end termination 2 of the present disclosure is shown. The end termination 2 is configured to receive and engage an elevator belt 4 of an elevator system to assist an elevator car in moving within a hoistway. The elevator belt 4 may be a single belt or a plurality of belts. In one example, the elevator belt 4 is a polyurethane coated elevator belt. The elevator belt 4 may be connected to an elevator car and/or a counterweight in the hoistway. The end termination 2 may include a housing 6 having a front (e.g., first) cover plate 8, a rear (e.g., second) cover plate 10, and left (e.g., first) and right (e.g., second) wedge housing members 12, 14 secured between the cover plates 8, 10. The cover plates 8, 10 may be connected to the wedge housing members 12, 14 using mechanical methods such as mechanical fasteners, adhesives, welding, or any other connection method for securing the cover plates 8, 10 to the wedge housing members 12, 14. The housing 6 may also be formed as a monolithic structure.

Each cover plate 8, 10 may define an aperture 16 in a central portion thereof for inspection of the components of the end termination 2. A connection rod 18 may be connected to and/or held by the cover plates 8, 10. The connection rod 18 may be adapted to be connected to an anchor point in the hoistway to hold the end termination 2 within the hoistway.

Figure 2B:
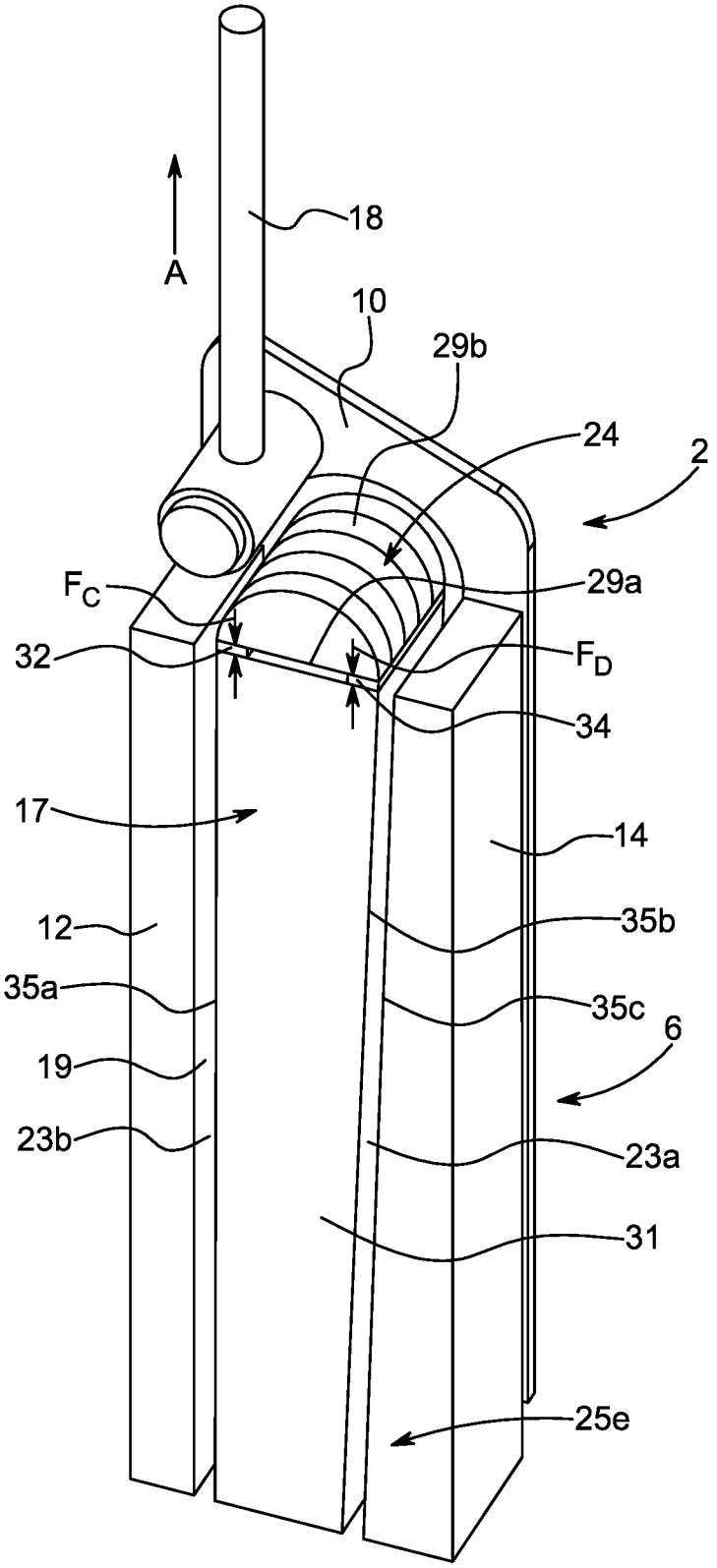
FIG. 2B is a perspective view of another example of the end termination of FIG. 1.

With reference to FIGS. 2A and 2B, the end termination 2 defines a cavity 19, such as an axial cavity, to axially receive a segmented wedge 17 therein. The segmented wedge 17 includes at least two wedge members. The at least two wedge members may include, but are not limited to: (1) a pair of corresponding longitudinally-extending wedge members 20, 22 and a wedge crown assembly 24; (2) a pair of corresponding longitudinally-extending wedge members 20, 22; and (3) a longitudinally-extending wedge member 31 and a wedge crown assembly 24. The longitudinally-extending wedge members 20, 22, 31 and the wedge crown assembly 24 interact with one another to control movement of the elevator belt 4 that has been reeved through the end termination 2. As noted, the segmented wedge 17 is disposed axially within the housing 6.

As shown in FIG. 2A, in an example of the segmented wedge 17 that includes two longitudinally-extending wedge members 20, 22 and a wedge crown assembly 24, a space, such as a longitudinal slot 21, may be defined between the longitudinally-extending wedge members 20, 22 such that the longitudinally-extending wedge members 20, 22 are spaced apart longitudinally from one another in the end termination 2. One longitudinally-extending wedge member 22 and the right wedge housing member 14 may define a first outer longitudinal slot 23*a* for passage of the elevator belt 4 therebetween. The other longitudinally-extending wedge member 20 and the left wedge housing member 12 may define a second outer longitudinal slot 23*b* for passage of the elevator belt 4 therebetween. The first and second outer longitudinal slots 23*a*, 23*b* allow the elevator belt 4 to be reeved through the end termination 2.

Further, the wedge crown assembly 24 is disposed opposite a substantially planar upper (e.g., first) end 25*a*, 25*b* of the respective longitudinally-extending wedge members 20, 22. The wedge crown assembly 24 may have a substantially planar lower (e.g., first) surface 29*a* that faces the upper/first ends 25*a*, 25*b* of the longitudinally-extending wedge members 20, 22. The wedge crown assembly 24 further has an arcuate upper surface 29*b* over which the elevator belt 4 is reeved, that faces away from the longitudinally-extending wedge members 20, 22 and allows smooth passage of the elevator belt 4 through the longitudinal slots 23*a*, 23*b*. In one example, the wedge crown assembly 24 may be a single monolithic structure. In another example, shown in FIG. 3, the wedge crown assembly 24 may be segmented into several individual wedge crown segments 26*a*-26*e* with a slot 27 defined between each wedge crown segment 26*a*-26*e*. The wedge crown assembly 24 and the upper ends 25*a*, 25*b* of the longitudinally-extending wedge members 20, 22 may be separated by a space, such as a transverse slot 33, that separates the wedge crown assembly 24 from the wedge members 20, 22. The elevator belt 4 passes between the wedge housing members 12, 14 and the longitudinally-extending wedge members 20, 22 and over the wedge crown assembly 24 within the end termination 2.

In one example, one longitudinally-extending wedge member 20 may be a counter wedge member. In this disclosure, "longitudinally-extending wedge member 20" and "counter wedge member 20" may be used interchangeably. The other longitudinally-extending wedge member 22 may be an angled wedge member. In this disclosure, "longitudinally-extending wedge member 22" and "angled wedge member 22" may be used interchangeably. In one particular example, the left wedge member housing 12 and the counter wedge member 20 may be substantially rectangular and have a uniform thickness from the first end 25*a* to an opposing second end 25*c*, and, the right wedge member housing 14 and the angled wedge member 22 may have a decreasing thickness from the first end 25*b* to an opposing second end 25*d*. In this example, the right wedge member housing 14 and the angled wedge member 22 may have opposing decreasing thicknesses such that a thicker end 25*e* of the right wedge member housing 14 is provided opposite the end of the angled wedge member 22 that has a lesser thickness.

In another example of the segmented wedge 17, it is contemplated that the wedge crown assembly 24 is integrated with the upper ends 25*a*, 25*b* of the longitudinally-extending wedge members 20, 22, such that the upper ends 25*a*, 25*b* of the wedge members 20, 22 have a generally curved or arcuate shape that mimics the curved surface or shape of the wedge crown assembly 24. The pair of longitudinally-extending wedge members 20, 22 may be connected with the curved surface at their respective upper ends 25*a*, 25*b*, and remain spaced from one another by the longitudinal slot 21.

As shown in FIG. 2B, in another example, the segmented wedge 17 may be provided as a singular longitudinally-extending wedge member 31 with the wedge crown assembly 24 described above. The longitudinally-extending wedge member 31 may be formed by combining the longitudinally-extending wedge members 20, 22 described above into a singular component. In this configuration, the longitudinally-extending wedge member 31 may include a substantially planar left (e.g., first) side surface 35*a* that is substantially parallel to a longitudinal axis of the end termination 2 and a substantially planar right (e.g., second) side surface 35*b* that is angled relative to the longitudinal axis of the end termination 2 to correspond to an angled surface 35*c* of the right wedge member housing 14. The longitudinally-extending wedge member 31 and the wedge crown assembly 24 may be spaced from one another by the transversely-extending slot 33, described previously, and which desirably extends the distance between the cover plates 8, 10.

During operation of the elevator system, the connection rod 18 of the end termination 2 is pulled upwardly within the hoistway in a direction A. As the connection rod 18 is pulled in direction A, force is exerted on the left and right wedge housing members 12, 14 in direction A. With force exerted on the wedge housing members 12, 14 in direction A, the elevator belt 4 is clamped between the thicker upper end 25*b* of the angled wedge member 22 and the thicker end 25*e* of the wedge housing member 14. Once the elevator belt 4 is clamped between the wedge housing member 14 and the angled wedge member 22, compressive forces are applied to members of the segmented wedge 17. In particular, the action of the elevator belt 4 creates compressive forces $F_A$, $F_B$ that urge the longitudinally-extending wedge members 20, 22 towards one another and compressive forces $F_C$, $F_D$ that urge the longitudinally-extending wedge members 20, 22 and the wedge crown assembly 24 towards one another. In the example in which the wedge crown assembly 24 is integrated with the upper ends 25*a*, 25*b* of the longitudinally-extending wedge members 20, 22, the action of the elevator belt 4 only creates compressive forces $F_A$, $F_B$ that urge the longitudinally-extending wedge members 20, 22 towards one another. In the example in which the segmented wedge 17 is provided as a singular longitudinally-extending wedge member 31 with the wedge crown assembly 24, the action of the elevator belt 4 only creates compressive forces $F_C$, $F_D$ that urge the longitudinally-extending wedge member 31 and the wedge crown assembly 24 towards one another.

Figure 3:
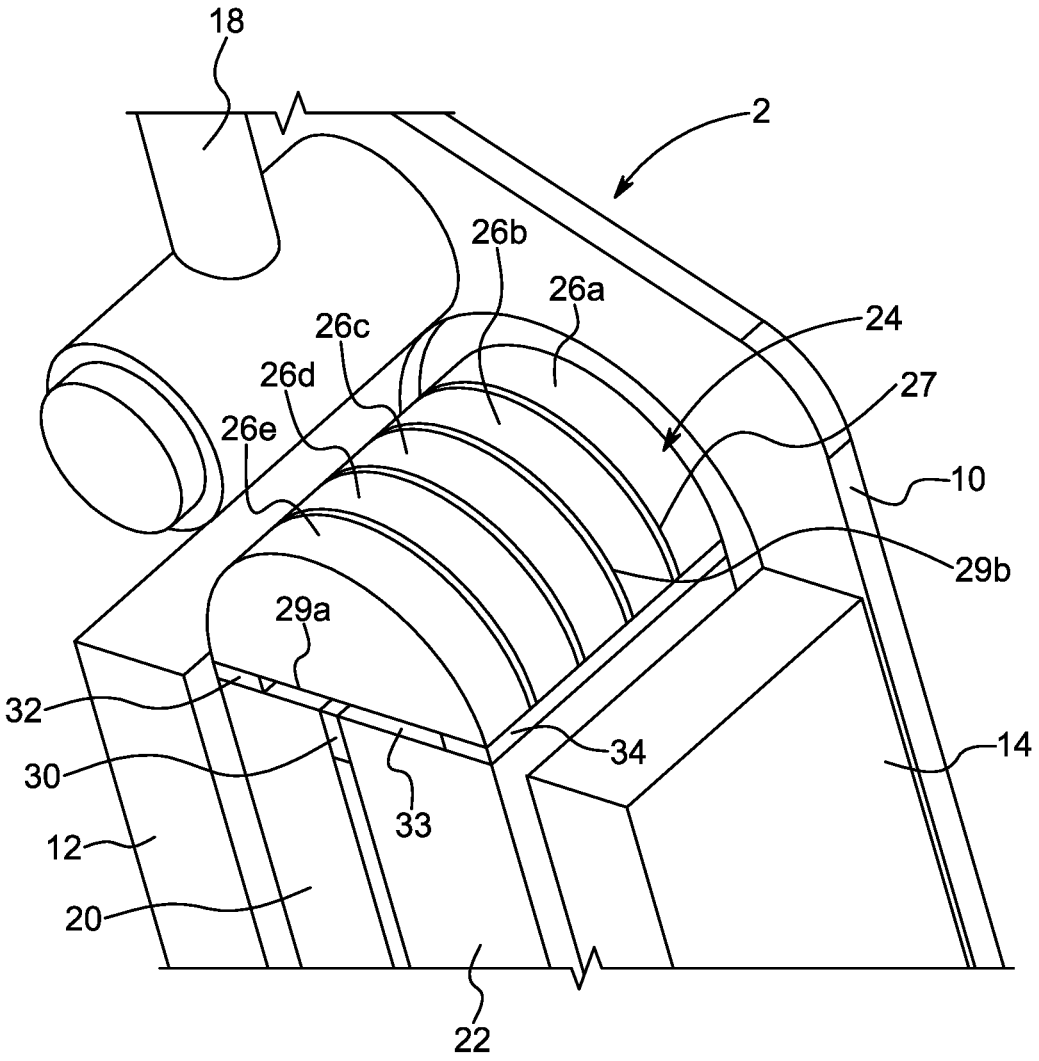
FIG. 3 is a top perspective view of a top portion of the end termination of FIG. 1.

With continued reference to FIGS. 2A, 2B, and 3, an elevator belt pressure monitoring system 37 is provided within the end termination 2 to monitor the integrity of the elevator belt 4 as it operates in conjunction with and is held within the end termination 2. The elevator belt pressure monitoring system 37 includes several pressure sensors 28, 30, 32, 34 arranged at different locations within the end termination 2. It is to be understood that the elevator belt pressure monitoring system 37 may use one of the following described pressure sensors, some of these pressure sensors, or all of these pressure sensors to monitor the integrity of the elevator belt 4 within the end termination 2. In one example, the pressure sensors 28, 30, 32, 34 are provided at different positions between the longitudinally-extending wedge members 20, 22 and the wedge crown assembly 24. Each pressure sensor 28, 30, 32, 34 may include a single pressure sensor or a row of a plurality of individual pressure sensors as needed.

A lower (e.g., first) wedge pressure sensor 28 may be held in the longitudinal slot 21 that is defined between the counter wedge member 20 and the angled wedge member 22 at a lower (e.g., second) end 25*c*, 25*d* of each longitudinally-extending wedge member 20, 22. The lower wedge pressure sensor 28 may be positioned within the longitudinal slot 21 between substantially planar inner surfaces 25*f*, 25*g* of the longitudinally-extending wedge members 20, 22. The lower wedge pressure sensor 28 is configured to register pressure readings of the compressive force $F_A$ applied to the lower ends 25*c*, 25*d* of the respective longitudinally-extending wedge members 20, 22.

An upper (e.g., second) wedge pressure sensor 30 may be positioned within the longitudinal slot 21 defined between the counter wedge member 20 and the angled wedge member 22 at the upper (e.g., second) end 25*a*, 25*b* of each longitudinally-extending wedge member 20, 22. The upper wedge pressure sensor 30 may be positioned in the longitudinal slot 21 between the inner surfaces 25*f*, 25*g* of the longitudinally-extending wedge members 20, 22. The upper wedge sensor 30 is configured to register pressure readings of the compressive force $F_B$ applied to the upper ends 25*a*, 25*b* of the longitudinally-extending wedge members 20, 22. It is also contemplated that the upper and lower wedge pressure sensors 30, 28 may be located between the longitudinally-extending wedge members 20, 22 at any position in the longitudinal slot 21 between the upper ends 25*a*, 25*b* and the lower ends 25*c*, 25*d* of the longitudinally-extending wedge members 20, 22. It is also contemplated that additional wedge pressure sensors may be positioned between the longitudinally-extending wedge members 20, 22 in the longitudinal slot 21 in addition to the upper and lower wedge pressure sensors 28, 30. In one example, the wedge pressure sensors 28, 30 are single sensors. In another example, the wedge pressure sensors 28, 30 include a plurality of individual sensors. The wedge pressure sensors 28, 30 may include load cells, pressure sensitive foils or paint, piezo elements, springs, fluid or air pockets, or lasers.

With continued reference to FIG. 3, a left (e.g., first) crown pressure sensor 32 is positioned in the transverse slot 33 between the counter wedge 20 and the wedge crown assembly 24. The left crown pressure sensor 32 may extend the entire width of the wedge crown assembly 24 and the upper end 25*a* of the counter wedge 20. The left crown pressure sensor 32 may be held in the transverse slot 33 between the upper end 25*a* of the counter wedge 20 and the lower surface 29*a* of the wedge crown assembly 24. The left crown pressure sensor 32 is configured to register pressure readings of the compressive force $F_C$ applied between an upper end 25*a* of the longitudinally-extending wedge member 20 and the lower surface 29*a* of the wedge crown assembly 24.

A right (e.g., second) crown pressure sensor 34 is positioned in the transverse slot 33 between the angled wedge 22 and the wedge crown assembly 24. The right crown sensor 34 may extend the entire width of the wedge crown assembly 24 and the upper end 25*b* of the angled wedge 22. The right crown pressure sensor 34 is held in the transverse slot 33 between the upper end 25*b* of the angled wedge 22 and the lower end surface 29*a* of the wedge crown assembly 24. The right crown pressure sensor 34 is configured to register pressure readings of the compressive force $F_D$ applied between the upper end 25*b* of the longitudinally-extending wedge member 22 and the lower surface 29*a* of the wedge crown assembly 24.

In another example, in an arrangement in which the wedge crown assembly 24 is separated into individual wedge crown segments 26, the left and right crown pressure sensors 32, 34 may comprise a number of pressure sensors equal to the number of individual segments 26 in the wedge crown assembly 24. For example, in an arrangement in which the wedge crown assembly 24 is separated into five different individual segments 26, the left and right crown pressure sensors 32, 34 may comprise at least five individual pressure sensors corresponding to each wedge crown segment 26. In one example, the crown sensors 32, 34 are single sensors extending the width of the individual segments 26. In the example discussed above, the crown pressure sensors 32, 34 include a plurality of individual sensors extending the width of the crown wedge assembly 24. The crown pressure sensors 32, 34 may include load cells, pressure sensitive foils or paints, piezo elements, springs, fluid or air pockets, or lasers.

Figure 4:
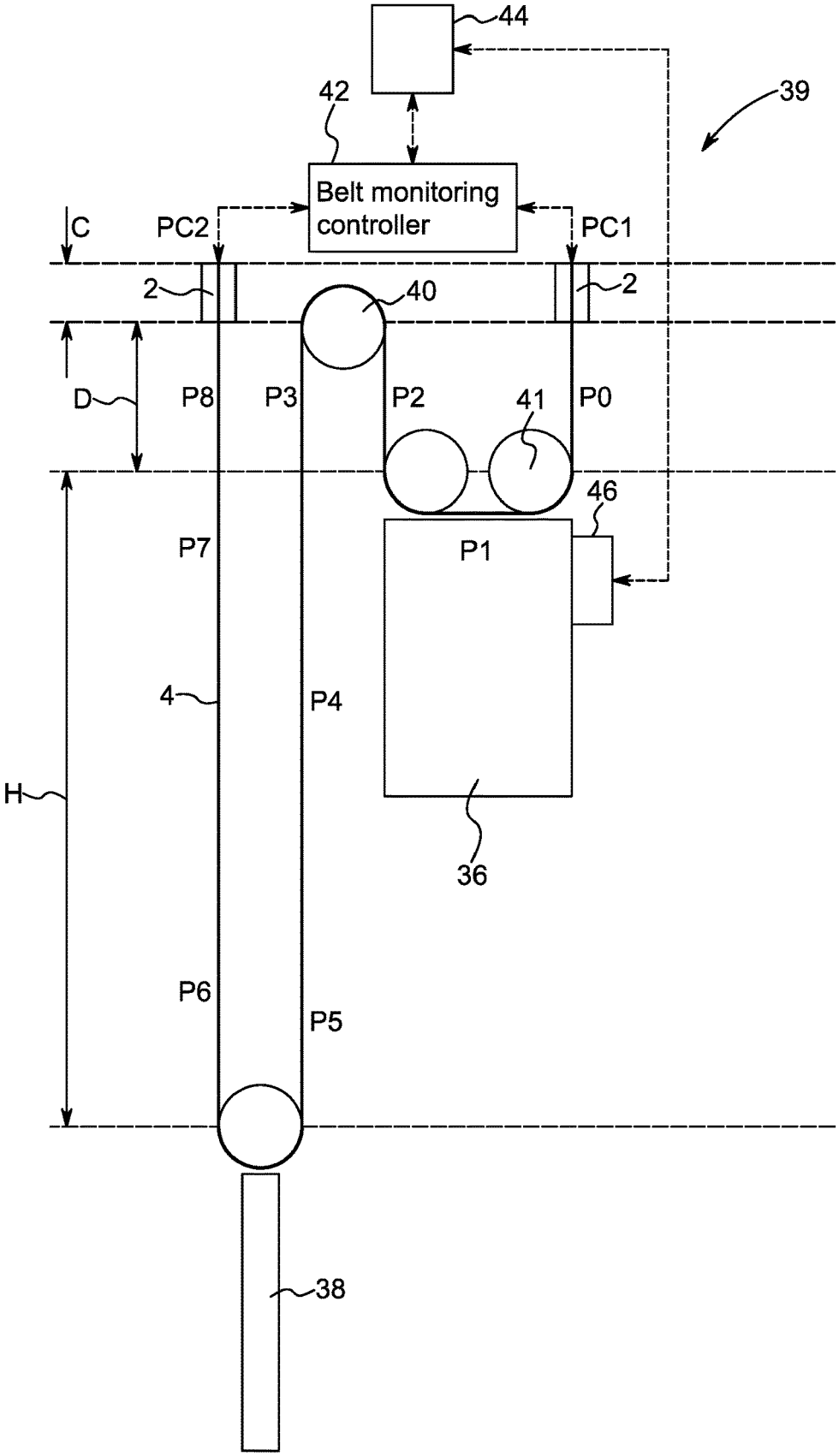
FIG. 4 is a schematic illustration of an elevator system according to an example of the present disclosure with an elevator car in a raised position.
Figure 5:
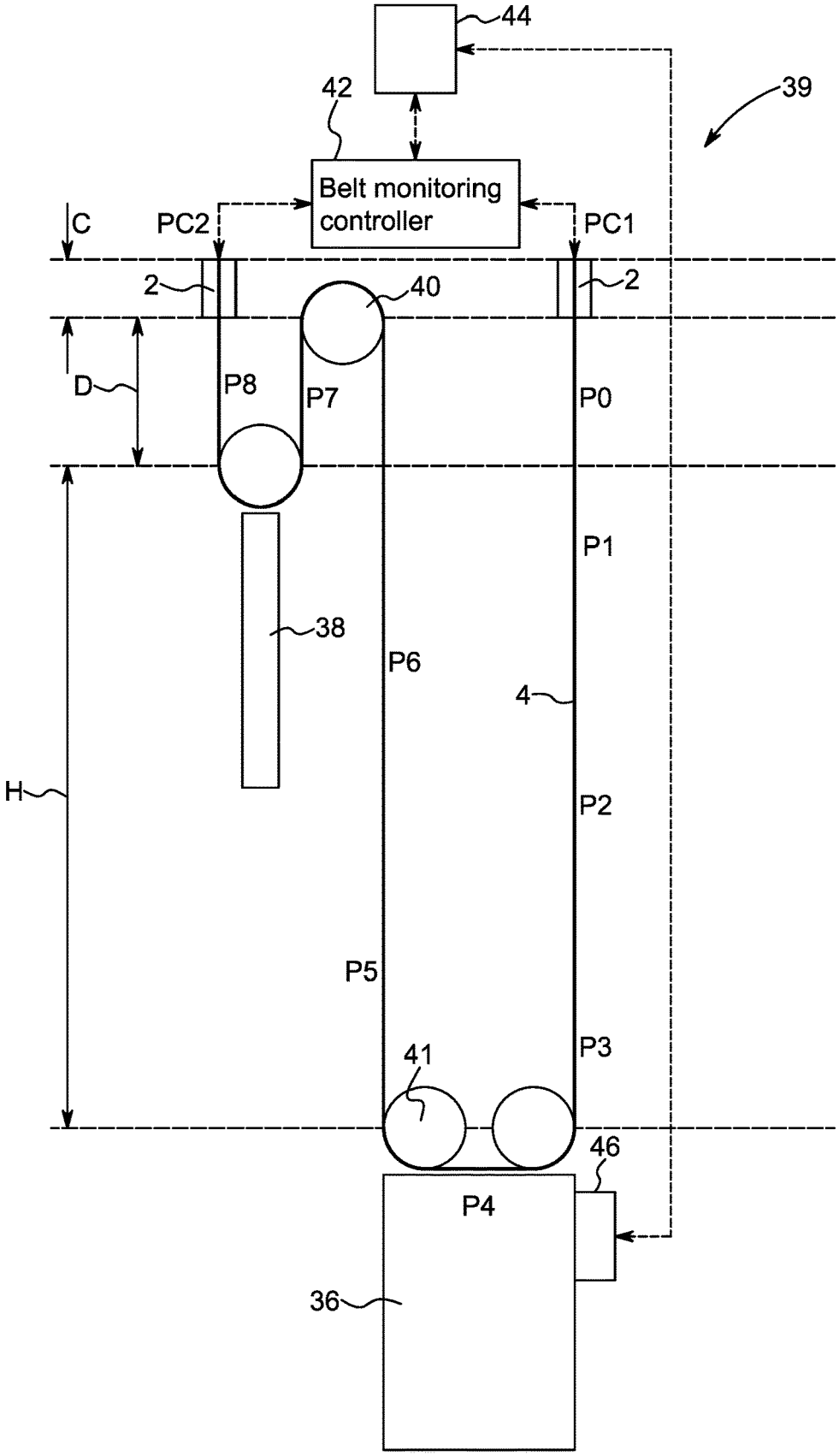
FIG. 5 is a schematic illustration of the elevator system of FIG. 4 with the elevator car in a lowered position.

With reference to FIGS. 4 and 5, an elevator system 39 according to one example of the present disclosure is discussed. The elevator system 39 may include at least one elevator car 36 and a counter weight 38. In one example, the elevator system 39 may include a single elevator car or multiple elevator cars. The elevator car 36 may move through the building in a vertical direction (y-axis), a left-right direction (x-axis), a front-rear direction (z-axis), or any multi-dimensional direction vector within a building. The elevator car 36 may move through the building using any method that is known in the art or future-developed for moving an elevator car 36 in an elevator system 39. In one example, at least one elevator belt 4 operatively connects to and extends between the elevator car 36 and the counterweight 38. In another example, at least one elevator belt 4 operatively connects to and extends between the elevator car 36 and a second elevator car (not shown). In one example, a plurality of elevator belts 4 are used to move the elevator car 36 through the hoistway of the building. The counterweight 38 or second elevator car are configured to create tension in the elevator belt 4 to provide a degree of travel control of the elevator belt 4 to control the travel of the elevator car 36. While the tension can be created by a passive weight system, such as a second elevator car or the counterweight 38, the tension can also be created by a mechanical tensioning system, such as a spring system or a high traction system with grooved belt and spool designs.

The elevator belt 4 is directed over/under on or more drive sheaves 40 and one or more deflector sheaves 41 provided in the hoistway through which the elevator car 36 is moved. The one or more drive sheaves 40 are driven by one or more hoist motors (now shown) to raise and lower the elevator car 36 within the hoistway. FIG. 4 depicts the elevator car 36 in a raised position and the counterweight 38 in a lowered position. FIG. 5 depicts the elevator car 36 in a lowered position and the counterweight 38 in a raised position. Each end of each elevator belt 4 is received in an end termination 2, such as the end termination 2 described hereinabove. At least one end termination 2 may include the elevator belt pressure monitoring system, including at least one of the pressure sensors 28, 30, 32, 34, described hereinabove. The elevator belt pressure monitoring system 37 may be in direct or indirect communication with a belt monitoring controller 42, which is described in greater detail below. The belt monitoring controller 42 may be in direct or indirect communication with an elevator system controller 44 that controls the operation of the elevator system 39. In another example, the belt monitoring controller 42 is provided as a feature of the elevator system controller 44.

An elevator car controller 46 may be provided on the elevator car 36. In other embodiments, the elevator car controller 46 may be located remotely from the elevator car 36, for example, in the hoistway wall. The elevator car controller 46 may be used to communicate with the elevator system controller 44 or other components in the elevator system 39. In one example, the elevator car controller 46 may be a controller that is part of a control panel, such as a microprocessor, a microcontroller, a central processing unit (CPU), and/or any other type of computing device. However, additional control systems or components that direct information through signals to other control systems may also be used for the elevator car controller 46. The elevator car controller 46 may be in wireless communication with the elevator system controller 44. The elevator system controller 44 may receive and/or communicate information from the elevator car controller 46 regarding the current position of the elevator car 36 and/or the travel rate of the elevator car 36, among other information regarding the elevator car 36. In one example, the elevator system controller 44 may be a controller that is part of a control panel, such as a microprocessor, a microcontroller, a CPU, and/or any other type of computing device. The elevator system controller 44 may be in wired and/or wireless communication with each separate elevator car 36 included in the elevator system 39. It is also contemplated that the elevator system controller 44 may be provided with the elevator car controller 46 or may be housed in one of the elevator cars 36 of the elevator system 39. The elevator system controller 44 may be in wired and/or wireless communication with at least one user interface (not shown) provided at one or more of a plurality of loading stations within the building for users to enter and exit the elevator car 36. In one example, the user interface may be a control panel or similar display that allows a user to select a desired destination and route within the building. The user interface may include a CPU or other controller in wireless communication with the elevator system controller 44. Information from the elevator system controller 44 regarding the elevator car 36 may be received by the user interface. It is also contemplated that each elevator car controller 46 may be in wireless communication with the user interface. Each elevator car controller 46 may transmit information regarding the elevator car 36 directly to the user interface.

The elevator belt pressure monitoring system 37, discussed above, is a monitoring method that monitors the entire length of the elevator belt 4 including the portion of the elevator belt 4 that is held in the end termination 2. The degradation of the elevator belt 4 is not equal over the entire belt length. FIG. 4 shows a 2:1 elevator setup with ten degradation zones (PC1, P0-P8, PC2) that correspond to a number of bends in the elevator belt 4, except the end terminations 2, which have no bends. In the table in FIG. 8, all of the degradation zones (PC1, P0-P8, PC2) are listed with the associated number of bends. The sheave 40 is connected to the a motor and brake and divides the whole belt length into two oscillation zones, the Counterweight and Car oscillation zone. The end termination 2 (PC2) measures the oscillations of the Counterweight oscillation zone and the end termination 2 (PC1) measures the oscillations of the Car oscillation zone. Since all other sheaves rotate freely, the bending zones (P0-P8) in FIG. 4 can be considered as springs and dampers arranged in parallel. With the known length of the bending zones (P0-P8) and the known number of bending cycles for each bending zone (P0-P8), as well the known car positions in a time interval, the spring constant (degradation) can be calculated for each bending zone. The elevator belt length which is clamped in the end terminations 2 cannot elongate freely. Therefore, different methods need to be applied to determine the belt degradation of the clamped belt length in the end terminations 2. Since the crown radius is much smaller than the sheave radius, the crown radius acts like a sharp edge for the elevator belt 4. Each impact force, such as from a jumping counterweight, creates fatigue in the crown bending zone of the elevator belt 4 and afterwards, for example 20-50 impact forces, a critical degradation can be reached. Fatigue in the crown area can be also caused by pulsating crown loads during normal elevator operation. The degradation in the crown bending zone is accelerated due to an unequal load distribution in the cords, which happens typically in a fatigued belt or misaligned belt. Therefore, the measurement of the pressure collective between the crown assembly 24 and the longitudinal-extending wedge members 12, 14 is considered as sufficient to determine the degradation of the elevator belt portion bent over the crown assembly 24. If the crown assembly 24 is divided in at least two parts 26*a*-26*e*, an accelerated degradation as well as misalignment can be detected.

During elevator operation, the elevator belt 4 may be exposed to fatigue and, in the event a fatigue cycle number increases, a cross section of the load carrier of the elevator belt 4 (e.g., a metallic cross section of a steel cord elevator belt) becomes smaller. The cross sectional area of the load carrier (A) of the elevator belt 4 is directly proportional to a belt breaking strength ($F_B$): $F_B=(\sigma_{0.2})(A)$. For example, the yield strength ($\sigma_{0.2}$) of carbon steel or carbon composites is between 1,800 and 2,800 MPa. A belt elongation ($\Delta l$) of an elevator belt (with the length (L) having a tensile force (F) and a Young's Modulus (E)) is $(\Delta l/L)=F/((E)(A))$. Therefore, the belt breaking force ($F_B$) and the belt elongation ($\Delta l$) or a spring constant ($\Delta l/L$) are a function of the cross sectional area (A) of the belt load carrier. According to current elevator system regulations, an elevator belt needs to be replaced if the belt reaches 60% residual breaking strength compared to a new elevator belt. A 40% loss of the cross sectional area is considered sufficient for a longitudinal frequency measurement in an elevator belt. Therefore, the residual breaking strength of an elevator belt can be calculated based on a longitudinal frequency and tensile force measurement in the end termination 2. The observed belt length (L) may be determined based on a car position signal of an elevator car 36 in the elevator system 39. Other elevator belt properties, such as a bending rigidity, dampening factor, and belt mass per length, also change with increasing fatigue and may influence the measured frequency spectrum.

In one example, it is an advantage to direct not only the car position to the elevator belt pressure monitoring system 37, but also any kinematic signals, such as an actual speed and operating conditions (e.g., emergency braking) of the elevator car 36. Using the pressure sensors 28, 30, 32, 34, a measurement of a mechanical frequency spectrum and tension force of the elevator belt 4 in each end termination 2 of the elevator system 39 may be obtained. The mechanical frequency spectrum is a measurement of the oscillation of the elevator belt 4 in the elevator system 39. The mechanical frequency spectrum may be affected by a speed, load position, load change, acceleration, position, and/or length of the elevator belt 4. These factors may create vibrations or oscillations in the elevator belt 4. Based on the measurement of the mechanical frequency spectrum and the tension force of the elevator belt 4, the residual breaking strength of each elevator belt 4 in the elevator system 39 can be determined. The elevator motor and brake can be used as a vibration stimulator to excite the car and counterweight oscillation zones with pre-selected frequencies, e.g. if the car is not occupied. A comparison of the frequency response measured in the end terminations 2 with the excitation frequency, e.g. amplitudes, phase differences and resonance frequencies, as well as frequency propagation times, allow the calculation of the belt degradation. Other elevator parts, such as active compensation rope dampening systems or active car dampening systems, can also be used as oscillation stimulators, if available.

After reaching a critical loss of breaking strength in the elevator belt 4, an operator may be notified that the elevator belt 4 needs to be replaced. By using the pressure sensors 28, 30, 32, 34 that include a row of pressure sensors along the width of the elevator belt 4, it is another advantage of the elevator belt pressure monitoring system 37 that unequal loading in the elevator belt 4 may be detected in a belt width direction in order to detect loose cords or extensive fleet angles for the elevator belt 4.

Figure 6:
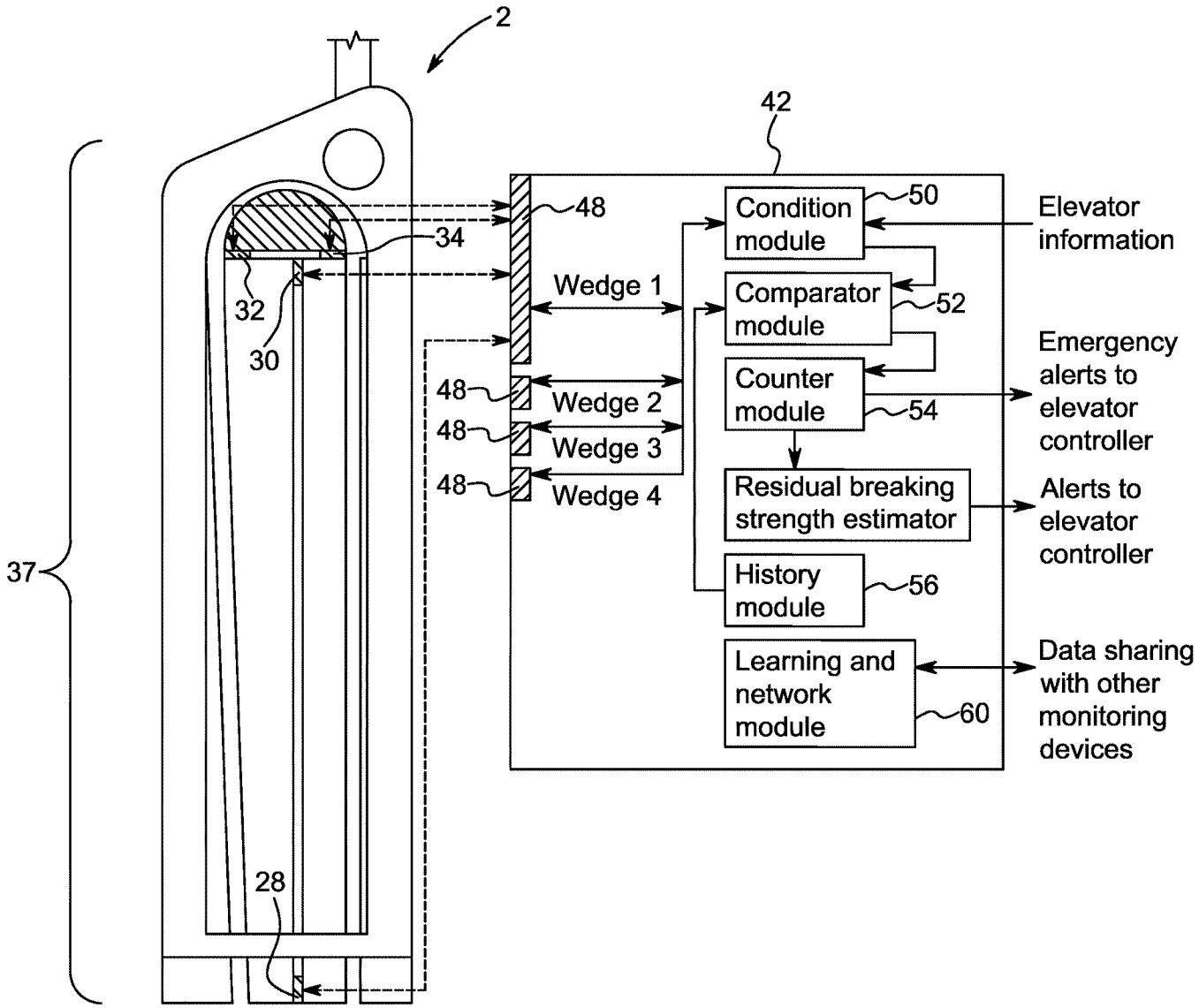
FIG. 6 is a schematic illustration of an elevator belt pressure monitoring system according to an example of the present disclosure.

With reference to FIG. 6, the belt monitoring controller 42 will now be described in greater detail. The belt monitoring controller 42 may also communicate either directly or indirectly with a remote monitoring center (not shown) (i.e., through the elevator system controller 44 or the elevator car controller 46). The belt monitoring controller 42 may include at least one wedge input module 48 corresponding to each pressure sensor 28, 30, 32, 34 provided in the end termination 2. The wedge input modules 48 may be in direct or indirect communication with each pressure sensor 28, 30, 32, 34 to receive pressure readings from each pressure sensor 28, 30, 32, 34. The pressure readings received by the wedge input modules 48 are supplied or directed to a condition module 50 that determines the actual condition of the compressive pressure sensor readings, as well as the operating conditions of the elevator system, such as position, car load, speed, and acceleration, as well as emergency conditions including activated brakes and safety gear. The condition module 50 may receive the elevator information from one of the elevator car controllers 46, the elevator system controller 44, or the information may be input by an operator into the belt monitoring controller 42. The condition module 50 sends this compiled information to a comparator module 52 for evaluation. The compiled information may be a data set with a time stamp to identify when the data was compiled.

The comparator module 52 compares the actual condition of the elevator belt 4 with previous conditions of the elevator belt 4 and/or stored threshold values for the elevator belt 4. This previous information and/or stored threshold values may be stored in a history module 56 of the belt monitoring controller 42, the elevator system controller 44, and/or a remote location that may be accessed by the belt monitoring controller 42 and/or the elevator system controller 44. The history module 56 may store belt-related data for maintenance purposes, including belt overloading conditions, excessive fleet angles, unequal belt tensioning, a number of bending cycles, emergency operating conditions (e.g., safety gear engagement), as well as residual breaking strength information recorded at predetermined time intervals.

The comparator module 52 may compare the actual condition of the elevator belt 4 with previous conditions of the elevator belt 4 and/or stored threshold values for the elevator belt 4 to determine whether any deviations between the readings are present. The comparator module 52 may also consider and take into account the current operation conditions of the elevator system 39. In one example, since the comparator module 52 considers the current operation conditions of the elevator system 39, only stored sensor signal information measured under similar conditions are compared with the actual pressure readings by the comparator module 52. In one example, if an emergency braking condition with an empty car in a top floor of the building performed two years ago shows significantly different sensor signals compared with actual emergency stop readings under the same conditions, the comparator module 52 may declare one deviation and inform a counter module 54 about the deviation and other possible deviations that were identified. The counter module 54 may issue an emergency warning or alert to the elevator car controller 46 and/or the elevator system controller 44 to notify a passenger and/or operator of the emergency condition in the elevator system 39. In another example, in the event a stored threshold value is exceeded, for example, and the elevator car 36 is moving but no frequency and tension in the elevator belt 4 are measured (e.g., loss of the elevator belt 4), the counter module 54 may send an emergency alert directly to the elevator system controller 44 and/or the elevator car controller 46. The counter module 54 counts all deviations in different and defined time intervals. For example, the deviations may be counted and monitored once a week, once a day, once an hour, and/or once a minute.

The belt monitoring controller 42 may also include a residual breaking strength estimator module 58 (hereinafter referred to as "estimator module 58") that is in communication with the counter module 54. The estimator module 58 may receive the number of deviations from the counter module 54 in predetermined time intervals and estimates the residual breaking strength of the elevator belt 4. The number of deviations ($D_i$) in a time interval ($T_i$) is considered a function of the residual breaking strength loss ($\Delta F_B$): $\Delta F_B = f\ \Sigma_i(D_i, T_i)$. The estimator module 58 may then send alerts to the elevator system controller 44 and/or the elevator car controller 46 regarding the remaining belt breaking strength of the elevator belt 4. Based on this information, maintenance personnel for the elevator system 39 can determine when the elevator belt 4 needs to be replaced. A learning and network module 60 may also be provided in the belt monitoring controller 42. The learning and network module 60 continuously works to improve the residual breaking strength estimation and prediction for the elevator belt 4. The detection of critical oscillations, which are an indication of fatigued belts, are based on calculations and comparisons. Parameters and correction factors are needed for the calculations. Some parameters and correction factors depend on, e.g. installation and manufacturing tolerances, as well as the building type and design. The determination of the parameters for new installations can be simplified if parameters in existing similar elevators are available. An update of older elevators with newer parameter sets can improve the field reliability of the elevator belt pressure monitoring system 37 and prevent call backs.

Figure 7:
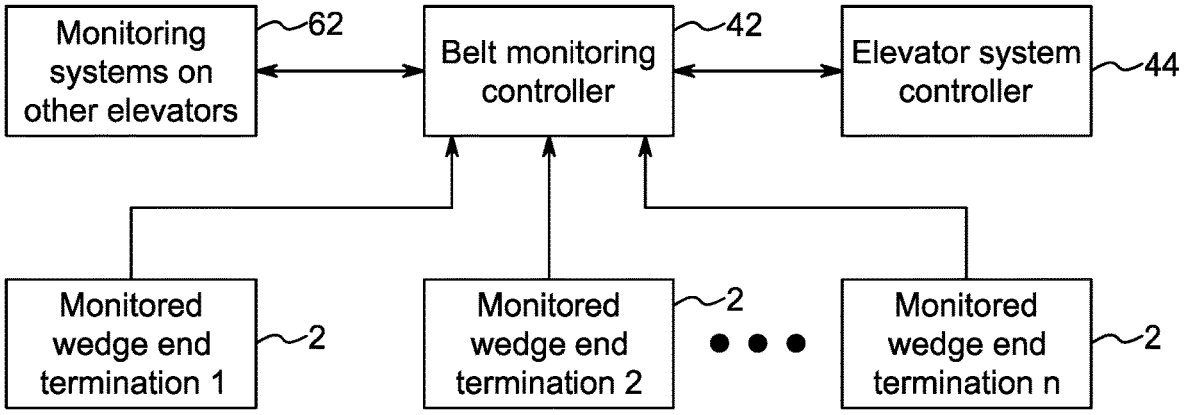
FIG. 7 is a schematic illustration of an elevator belt pressure monitoring system according to another example of the present disclosure.

As shown in FIG. 7, the learning and network module 60 may also be in communication with other belt monitoring systems 62 installed on other elevator systems. The learning and network module 60 may share information regarding the elevator system 39 with other elevator systems. Each of the elevator systems 39, 62 can learn from one another based on residual breaking strength estimations that are recorded by the estimator module 58. By increasing the accuracy of the residual breaking strength estimates, maintenance personnel can more accurately determine when the elevator belt 4 needs to be replaced in the elevator system 39.

While several examples of a system and method for monitoring an elevator belt were shown in the accompanying figures and described in detail hereinabove, other aspects will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. An elevator end termination for an elevator belt, comprising:

a wedge housing;

a segmented wedge disposed axially within the wedge housing;

wherein the segmented wedge comprises at least two wedge members spaced apart from one another to define a space therebetween;

at least one pressure sensor disposed in the space defined between the at least two wedge members; and wherein the at least one pressure sensor registers compressive pressure exerted between the at least two wedge members.

2. The elevator end termination as claimed in claim 1, wherein the at least two wedge members comprise a pair of adjacent longitudinally-extending wedge members and the space is a longitudinal slot between the adjacent wedge members.

3. The elevator end termination as claimed in claim 2, wherein the pair of adjacent longitudinally-extending wedge members comprise an angled wedge and an opposing counter wedge.

4. The elevator end termination as claimed in claim 2, wherein the at least one pressure sensor comprises a first pressure sensor provided in the longitudinal slot at a first end of the longitudinal slot.

5. The elevator end termination as claimed in claim 4, wherein the at least one pressure sensor further comprises a second pressure sensor provided in the longitudinal slot at a second end of the longitudinal slot.

6. The elevator end termination as claimed in claim 2, wherein the at least one pressure sensor includes a first pressure sensor provided in the longitudinal slot at a first end of the longitudinal slot, and a second pressure sensor provided in the longitudinal slot at a second end of the longitudinal slot.

7. The elevator end termination as claimed in claim 1, wherein the at least two wedge members further comprise:

a pair of adjacent longitudinally-extending wedge members, and the space is a longitudinal slot between the adjacent wedge members; and a wedge crown adjacent a first end of each of the longitudinally-extending wedge members and separated therefrom by a transversely-extending space.

8. The elevator end termination as claimed in claim 7, wherein the pair of adjacent longitudinally-extending wedge members comprise an angled wedge and an opposing counter wedge.

9. The elevator end termination as claimed in claim 7, wherein the at least one pressure sensor comprises a first pressure sensor provided in the longitudinal slot at a first end of the longitudinal slot.

10. The elevator end termination as claimed in claim 9, wherein the at least one pressure sensor further comprises a second pressure sensor provided in the longitudinal slot at a second end of the longitudinal slot.

11. The elevator end termination as claimed in claim 7, wherein the at least one pressure sensor comprises a first pressure sensor provided in the longitudinal slot at a first end of the longitudinal slot, and a second pressure sensor provided in the longitudinal slot at a second end of the longitudinal slot.

12. The elevator end termination as claimed in claim 7, wherein the wedge crown comprises a plurality of adjacent wedge crown elements disposed adjacent the first end of each of the longitudinally-extending wedge members.

13. The elevator end termination as claimed in claim 7, wherein the transversely-extending space comprises a transverse slot, and the at least one pressure sensor is provided in the transverse slot between the wedge crown and the longitudinally-extending wedge members.

14. The elevator end termination as claimed in claim 1, wherein the at least two wedge members further comprise:

a longitudinally-extending wedge member; and a wedge crown adjacent a first end of the longitudinally-extending wedge member and separated therefrom by a transversely-extending space.

15. The elevator end termination as claimed in claim 14, wherein the at least one pressure sensor is provided in the transverse space between the wedge crown and the longitudinally-extending wedge member.

16. The elevator end termination as claimed in claim 14, wherein the wedge crown comprises a plurality of adjacent wedge crown elements disposed adjacent the first end of the longitudinally-extending wedge member.

17. The elevator end termination as claimed in claim 16, wherein the transversely-extending space comprises a transverse slot, and wherein the at least one pressure sensor is provided in the transverse slot between the wedge crown and the longitudinally-extending wedge member.

18. The elevator end termination as claimed in claim 1, wherein the wedge housing comprises a first wedge housing member and a second wedge housing member defining a cavity therebetween axially receiving the segmented wedge therein, and wherein the segmented wedge defines a pair of outer longitudinal slots with the first wedge housing member and the second wedge housing member to accommodate an elevator belt reeved through the elevator end termination.

19. The elevator end termination as claimed in claim 18, wherein the at least two wedge members comprise a pair of adjacent longitudinally-extending wedge members and the space is a longitudinal slot defined between the adjacent wedge members, wherein the pair of adjacent longitudinally-extending wedge members comprise an angled wedge and an opposing counter wedge, and wherein the angled wedge defines a first angled face and one of the first wedge housing member and the second wedge housing member defines a second angled face disposed opposite the first angled face.

20. The elevator end termination as claimed in claim 18, further comprising a first cover plate and a second cover plate secured to the first wedge housing member and the second wedge housing member to enclose the cavity, with the segmented wedge axially disposed between the first wedge housing member and the second wedge housing member and between the first cover plate and the second cover plate.

* * * * *